US006449452B1

(12) United States Patent
Kai

(10) Patent No.: US 6,449,452 B1
(45) Date of Patent: Sep. 10, 2002

(54) METHOD AND APPARATUS FOR IMAGE DEVELOPING CAPABLE OF USING DEVELOPER IN A MAGNET BRUSH FORM

(75) Inventor: Tsukuru Kai, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/567,523

(22) Filed: May 10, 2000

(30) Foreign Application Priority Data

May 10, 1999 (JP) ..... 11-128654

(51) Int. Cl.[7] ..... G03G 15/09
(52) U.S. Cl. ..... 399/267; 399/277
(58) Field of Search ..... 399/267, 274, 399/275, 277; 430/122

(56) References Cited

U.S. PATENT DOCUMENTS 4,511,239 A * 4/1985 Kanbe et al. ..... 399/138
4,887,131 A * 12/1989 Kinoshita et al. ..... 399/275
5,396,026 A * 3/1995 Sato et al. ..... 399/276
5,659,861 A * 8/1997 Yamashita et al. ..... 399/267
5,754,929 A * 5/1998 Nonomura et al. ..... 399/275
5,758,241 A * 5/1998 Oyama et al. ..... 399/272
6,219,514 B1 * 4/2001 Kobayashi et al. ..... 399/277

FOREIGN PATENT DOCUMENTS

| | | |
|---|---|---|
| JP | 02-132478 | 5/1990 |
| JP | 03-095578 | 4/1991 |
| JP | 07-128981 | 5/1995 |
| JP | 10-020656 | 1/1998 |

* cited by examiner

*Primary Examiner*—Robert Beatty
(74) *Attorney, Agent, or Firm*—Oblon, Spivak, McClelland, Maier & Neustadt, P.C.

(57) ABSTRACT

An image developing apparatus includes a latent image carrying member and a developer carrying member. The developer carrying member carries developer which forms a magnetic brush on a surface thereof and causes the magnetic brush to brush a surface of the latent image carrying member in the developing region so that the latent image on the latent image carrying member is visualized. In the apparatus, a developing nip is formed relatively small so that a time period in which a toner of the magnetic brush moves to the developer carrying member back from the latent image carrying member is reduced and a density of the magnetic brush is increased. A developing magnetic pole of the developer carrying member has specific half-angle and attenuation rate values.

53 Claims, 9 Drawing Sheets

Fig. 8

TABLE

| EMBODIMENT 1 | | | | | | | | |
|---|---|---|---|---|---|---|---|---|
| MAGNET | P1 | P2 | P3 | P4 | P5 | P6 | P7 | P8 |
| POLARITY | N | S | S | S | N | S | N | S |
| F.D(mT) | 93.1 | 58.4 | 3 | 56.0 | 48.3 | 43.2 | 73.7 | 59.9 |
| H.V.A(°) | 16.2 | 25.3 | - | 23.7 | 26.4 | 25.5 | 19.8 | 29.1 |
| A.R(%) | 45.3 | | | | | | | |

| EMBODIMENT 2 | | | | | | |
|---|---|---|---|---|---|---|
| MAGNET | P1 | P2 | P3 | P4 | P5 | P6 |
| POLARITY | N | S | S | S | N | S |
| F.D(mT) | 87.8 | 45.3 | 4 | 45.3 | 57.1 | 55.2 |
| H.V.A(°) | 18.4 | 32.8 | - | 34.0 | 44.7 | 38.7 |
| A.R(%) | 44.2 | | | | | |

| EMBODIMENT 3 | | | | | | |
|---|---|---|---|---|---|---|
| MAGNET | P1 | P2 | P3 | P4 | P5 | P6 |
| POLARITY | N | S | N | S | N | S |
| F.D(mT) | 66.7 | 47.7 | 58.6 | 52.6 | 46.1 | 58.0 |
| H.V.A(°) | 21.6 | 25.5 | 27.3 | 37.2 | 26.0 | 24.3 |
| A.R(%) | 48.5 | | | | | |

| PRIOR ART EXAMPLE 1 | | | | | | |
|---|---|---|---|---|---|---|
| MAGNET | P1 | P2 | P3 | P4 | P5 | P6 |
| POLARITY | N | S | S | S | N | S |
| F.D(mT) | 95 | 90 | 5 | 50 | 60 | 55 |
| H.V.A(°) | 46 | 47 | - | 35 | 37 | 55 |
| A.R(%) | 28 | | | | | |

| PRIOR ART EXAMPLE 2 | | | | | | |
|---|---|---|---|---|---|---|
| MAGNET | P1 | P2 | P3 | P4 | P5 | P6 |
| POLARITY | N | S | S | S | N | S |
| F.D(mT) | 94 | 73 | 5 | 52 | 65 | 58 |
| H.V.A(°) | 45 | 46 | - | 35 | 55 | 40 |
| A.R(%) | 32 | | | | | |

| PRIOR ART EXAMPLE 3 | | | | | | |
|---|---|---|---|---|---|---|
| MAGNET | P1 | P2 | P3 | P4 | P5 | P6 |
| POLARITY | N | S | S | S | N | S |
| F.D(mT) | 95 | 90 | 5 | 50 | 60 | 55 |
| H.V.A(°) | 37 | 47 | - | 42 | 45 | 59 |
| A.R(%) | 37 | | | | | |

METHOD AND APPARATUS FOR IMAGE DEVELOPING CAPABLE OF USING DEVELOPER IN A MAGNET BRUSH FORM

CROSS-REFERENCE TO RELATED APPLICATIONS

This application claims priority under 35 U.S.C. §119 to Japanese patent application No. JPAP11-128654 filed on May 10, 1999, the entire contents of which are hereby incorporated by reference. This application contains subject matter relating to U.S. patent application Ser. No. 09/505,715 filed on Feb. 17, 2000, the entire contents of which are incorporated herein by reference.

BACKGROUND OF THE INVENTION

1. Field of the Invention

The present invention generally relates to a method and apparatus for image developing, and more particularly to a method and apparatus for image developing in which developer is caused to suitably form a magnetic brush in order to develop an image in a superior quality.

2. Discussion of the Background

In general, image forming apparatuses using an electrostatic recording method or an electrophotographic method, such as copiers, printers, facsimile machines, or the like, performs a common image forming operation. In such a common image forming operation, an electrostatic latent image is formed in accordance with original image information on a latent image carrying member including a photoconductive member such as a photoconductive drum, a photoconductive belt, or the like. Then, an image developing apparatus of the image forming apparatus performs an image developing operation relative to the latent image formed on the latent image carrying member so as to form a visible image.

Recently, a so-called magnetic brush image developing method using a two-component developer including toner and carriers has been mainstream in an image developing field, from viewpoints of image transferability, halftone reproducibility, stability of image development against varying temperature and humidity. With the magnetic brush image developing method, an image developing apparatus causes the two-component developer to form on a developer carrying member with a magnetic force thereof into a brush-like shape including a plurality of developer chain segments each made of chained developer particles. The developer thus formed in the brush-like shape is referred to as a magnetic brush. The magnetic brush formed on the developer carrying member supplies toner to a latent image formed on a latent image carrying member in a developing region which is formed between the developer carrying member and the latent image carrying member. The developing region is defined as a region in which the developer forms a magnetic brush on the developer carrying member and makes contact with the latent image carrying member.

The developer carrying member is generally composed of a hollow cylindrical sleeve (i.e., a developing sleeve) and a magnet member (i.e., a magnet roller) mounted inside the developing sleeve. The magnet roller forms magnetic fields for causing the developer deposited on the surface of the developing sleeve to rise in the form of a plurality of chain segments. More specifically, carrier particles contained in the developer rise along magnetic lines of force generated by the magnet roller and form developer chain segments. Onto such a developer chain segment, charged toner particles contained in the developer are deposited. The magnet roller includes a plurality of magnetic poles formed by the same plurality of magnets each of which has a rod-shape, for example. One of the magnets has a main magnetic pole (i.e., a developing magnetic pole) for especially causing the developer to form a magnetic brush relative to the developing region on the developing sleeve.

In the above configuration, when at least one of the developing sleeve and the magnet roller moves, it conveys the developer forming the rising developer chain segments towards the developing region. The developer brought to the developing region rises in the form of the magnetic brush along the magnetic lines of force generated by the main magnetic pole. As the head of the magnetic brush contacts the surface of the latent image carrying member, it yields itself. While the magnetic brush sequentially rubs against the latent image formed on the latent image carrying member at a speed determined on a basis of a difference of linear velocity between the developer carrying member and the developing sleeve, the toner is transferred from the developer carrying member to the latent image carrying member.

Conventionally, an analog image forming apparatus has been prone to cause a problem when a latent image is formed in a low contrast and has used an edge effect to compensate this problem. The edge effect is brought from relatively strong electrostatic fields which are generated around an image portion and a non-image portion of an electrostatic latent image formed on a photoconductive member. At an event that the edge effect is strong or great, or is produced, an electrostatic field is greater and an amount of toner used for image developing on an edge portion of an image is greater than that used for an inside portion of the image. As a result, the image will have a higher density. On the other hand, at an event that the edge effect is weak or small, or is not produced, an electrostatic field is smaller and an amount of toner used for image developing on an edge portion of an image is similar to that used for an inside portion of the image. As a result, the edge and inside portions of the image have even densities and the image will be produced in a superior quality.

However, a digital image forming apparatus which has recently come into widespread use has such a problem as described above. Accordingly, the digital image forming apparatus is required to develop an image in accordance with a latent image with as great a fidelity as possible so as to achieve an ideal image forming. To do this, the digital image forming apparatus is particularly required to perform a sophisticated image developing function capable of using a high image density. One known way for allowing an image developing to use a high image density is to make a developing gap narrow. The developing gap is specified as a distance between the latent image carrying member and the developer carrying member. Another known way is to make a developing nip wider. The developing nip is specified as a width of the developing region.

FIG. 1 shows variations of the edge effect when an image of one-dot-width vertical lines is developed with variations of a line density and the developing gap. In FIG. 1, the vertical axis represents a resultant edge effect ratio and the horizontal axis represents variations of the line density. When an image of one-dot-width vertical lines is developed with a line density of 150 lpi (lines per inch), the edge effect is defined as a value of 1. For example, as shown in FIG. 1, the edge effect with a developing gap (Gp) of 0.6 mm is flat at an edge effect level of 1 with the line density in a range of 150 lpi to 200 lpi but is increased to a value slightly below 1.4 with a line density of 100 lpi and to a value slightly below 1.7 with a line density of 50 lpi. For another example, the edge effect with a developing gap (Gp) of 400 $\mu$m is flat at the edge effect level of 1 with the line density in a range of 120 lpi to 200 lpi but is increased to a value about 1.05 with a line density of 100 lpi and to a value slightly above 1.2 with a line density of 50 lpi. With referring also to other examples having different Gp values shown in FIG. 1 in this way, it is understood that the edge effect is prone to reduce as the developing gap is made narrower.

More specifically, it is understood that an image of one-dot-width lines with a fixed Gp is prone to receive a greater edge effect when the image has a smaller line density, or a smaller spatial frequency, that is, each line in the image is isolated. The reason is that when a line is isolated electric force lines are concentrated onto the isolated line, thereby increasing the intensity of the electric field around the isolated line by which more toner is attracted to the isolated line. As a result, the isolated line becomes thicker. It is also understood, on the contrary, that an image of one-dot-width lines with a fixed Gp is prone to receive a smaller edge effect when the image has a greater line density, or a greater spatial frequency, that is, the image is dense. The reason for this is that when a spatial frequency is great electric force lines are not concentrated onto the lines, thereby decreasing the intensity of the electric field around the lines by which less toner is attracted to the lines. As a result, each of the lines becomes thinner.

It is also understood that when the developing gap is greater the edge effect ratio is increased and that the edge effect ratio can be made closer to an ideal value of 1 by making the developing gap narrower. That is, the edge effect can be decreased when the developing gap is made narrow. When the developing gap is wider, a number of electric force lines concentrating onto an edge portion of a line in an image increases amongst the electric force lines headed towards the opposite electric pole (i.e., the developing sleeve). Accordingly, the edge portion receives more toner and, as a result, the line becomes thicker. On the other hand, when the developing gap is narrower, the developing electric field deviated aside will be headed towards the opposite electric pole and the intensity of the electric field around the edge portion will accordingly be reduced. Accordingly, an edge enhancement effect will be reduced and, as a result, a ratio of line widths according to the difference of spatial frequencies is reduced. In addition, when the developing gap is made narrower, the intensity of the developing electric filed around the gap is increased and, therefore, a developing performance will be increased.

A high developing performance also brings a high gamma development which is an advantage for the digital binary developing method. A high gamma development is known to be a way for removing granularity. In the conventional dev eloping apparatus, however, the developing nip is wider when the developing gap is made narrower. It is known that a faulty image (i.e., a rear-edge omission problem) is produced typically when a solid black image is developed with a wider developing nip. Such a rear-edge omission problem appears particularly on a rear edge portion of a solid black image or a solid half-tone image, or a rear edge portion of a cross portion of solid black lines or solid half-tone lines. Also, a development with a wider developing nip produces another faulty image in which horizontal lines are developed thicker than vertical lines in an image having horizontal and vertical lines with an equal thickness, or in which such a small image as a one-dot is not developed.

The above-described rear-edge omission problem is a phenomenon of a faulty image which appears when the latent image carrying member and the developer carrying member standing opposite each other move in the same direction in the developing region. But, when the latent image carrying member and the developer carrying member move in the opposite directions each other, the omission problem will appear on a top edge portion on an image and a phenomenon of such a faulty image is therefore referred to as a top-edge omission problem.

Referring now to FIGS. 2A and 2B, detailed behaviors of toner in the above-described mechanisms are explained. In FIG. 2A, numeral references 101 and 141 denote parts of a latent image carrying member (i.e., a photoconductive member) and a developer carrying member (i.e., a developing sleeve), respectively. A latent image carrying member 101 is usually formed in a drum-like shape but in this case it is drawn as a flat plate member for the sake of convenience. The latent image carrying member 101 and the developer carrying member have a developing gap G between the two. The latent image carrying member 101 is connected to a ground and has a latent image potential on the surface thereof. The developer carrying member 141 is connected to a certain voltage Vb connected to a ground and carries the rising chain segments at positions H1, H2, H3, and H4, for example, on the surface thereof. These positions H1–H4 are within a developing nip N.

In FIG. 2A, a potential graph corresponding to the developing nip N is additionally drawn in which a boundary between a background portion and an image portion of a latent image arrives at substantially the center of the developing nip N. The latent image carrying member 101 and the developer carrying member 141 move in the same direction, but the former moves at a speed Sp lower than a speed Ss at which the latter moves. In this sense, it is assumed that the latent image carrying member 101 is stationary relative to the developer carrying member 141. As the developer carrying member 141 moves, a rising chain segment rises at the position H1 and the head thereof starts to contact the latent image carrying member 101. The rising chain segment further moves and then passes the position H2 while a head carrier particle thereof is rubbing itself against the background portion. The rising chain segment further moves and then passes the image portion at the position H3. Subsequently, the rising chain segment falls down at the position H4 with the result that the head carrier particle is released from the latent image carrying member 101. While the head carrier particles are moving from the position H1 to the position H4, i.e., throughout the distance of the developer nip N, these particles do not change their heights and individually roll.

FIG. 10B shows another condition of the latent image carrying member 101 and the developer carrying member 141 after a certain time period. In this condition, as time passes, the latent image carrying member 101 and the developer carrying member 141 relatively move and the rear end of the latent image is brought closer to the position H4.

FIGS. 3A–3D show the behaviors of the toner particles adhered to a head carrier particle of the rising chain segment of the magnet brush, relative to a part of the latent image carrying member 101, while the rising chain segment moves from the positions H1 through to H4. FIGS. 3A, 3B, 3C, and 3D represent conditions in which the rising chain segment passes the positions H1, H2, H3, and H4, respectively.

As shown in FIG. 3A, at the position H1, toner particles T adhere to a carrier particle C in a manner relatively uniform since the position H1 locates at an inlet of the developing nip N. A shown in FIG. 3B, at the position H2, the toner particles T move away from the latent image carrying member 101 since an electric field formed by the bias Vb and the electrostatic potential of the background of the latent image carrying member 101 has an orientation in the direction from the latent image carrying member 101 towards the developer carrying member (not shown in this drawing). As a result, the number of toner particles T decreases in the vicinity of the latent image carrying member 101. More specifically, since the carrier particle C rolls while moving in the developing nip N, the surface area of the carrier particle C adjoining the latent image carrying member 101 and where the number of toner particles T decreases increases with an increase in the width of the developing nip N.

As shown in FIG. 3C, at the position H3, an electric field formed by the bias Vb and the electrostatic potential of the image portion of the latent image carrying member 101 has an orientation in the direction from the developer carrying member to the latent image carrying member 101. However, the toner particles T moving downward cannot instantaneously deposit on the image of the latent image carrying member 101. During this interval, the part of the magnet brush which has moved away from the above image portion causes toner particles T' previously deposited on the latent image carrying member 101 to again deposit on the carrier particle C due to the counter charge of the particle C, as indicated by an arrow in FIG. 3C, which phenomenon is referred to as a toner return. As a result, the number of toner particles T on the carrier particle C increases while the number of toners on the trailing edge of the image formed on the latent image carrying member 101 decreases accordingly.

The counter charge of the carrier particle C decreases with the above increase in the number of toner particles T caused by the toner return phenomenon, so that the toner particles T are again caused to easily move to the head of the magnet brush. Specifically, as shown in FIG. 3D, at the position H4, the electric field directed from the developer carrying member toward the latent image carrying member 101 causes the toner particles T to move toward the latent image carrying member 101 away from the carrier particle 1. At the same time, the toner particles T' returned to the carrier particle C again deposit on the latent image carrying member 101.

As shown in FIG. 2B, the trailing edge of the image portion approaches the position H4 due to the relative moment of the developer carrying member 141 and the latent image carrying member 101. A rising chain segment then falls down in the condition shown in FIG. 3C. More specifically, substantial part of the toner particles T is returned from the latent image carrying member 101 to the carrier particle C. As a result, the top carrier particle of the rising chain segment falls down with only a small number of toner particles T remaining on the image portion, ending the development. This renders the rear-edge omission problem which is particularly conspicuous when it comes to a half-tone image. Moreover, when the linear velocity ratio is increased, a greater impact occurs when the magnet brush contacts the latent image carrying member 101 and reduces the adhesion of the toner particles T to the carrier particle C, thereby making the toner particles T easier to move. Under the development conditions in which the rear-edge omission problem will easily be generated, reproducibility of a horizontal line and a one-dot image will also be degraded.

In order to decrease the rear-edge omission problem, the line velocity of the developer carrying member 141 relative to the line velocity of the latent image carrying member 101 is decreased. However, this results a less toner supply and an image development with an insufficient density. Therefore, the line velocity ratio of the developer carrying member 141 relative to the line velocity of the latent image carrying member 101 is commonly set to around 1.1 to 1.2 so as to avoid an occurrence of the insufficient toner supply. The line velocity ratio of 1.2 is, however, still insufficient to develop an image in a superior quality. To improve such an image development, use of two developing carrying members has been introduced. In this case, twice of development are performed by the two developing carrying members at the line velocity of about 1.2 relative to the same latent image so that a sufficient amount of toner can be supplied. However, this solution brings problems of machine size and machine cost.

Also, as illustrated in FIGS. 3B and 3C, the carrier particle positioned on the top of the rising chain segment has a less number of toner particles thereon may negatively affect relative to the latent image by causing a toner drift for drifting a toner particle or a reduction of the counter charge. To reduce such a negative impact to the latent image, it is an efficient way to make the developing nip N narrow. On the other hand, making the developing gap G narrower is desired from the viewpoint of an increase of an intensity of the electric field promising a high development performance, so that an image development is performed with a high fidelity relative to an image which cannot expect an edge effect.

SUMMARY OF THE INVENTION

The present invention provides a novel image developing apparatus which includes a latent image carrying member and a developer carrying member. The latent image carrying member is configured to carry a latent image. The developer carrying member is provided in proximity to the latent image carrying member so as to form a developing region between the latent image carrying member and the developer carrying member and configured to carry developer which forms a magnetic brush on a surface thereof and to move the magnetic brush to the developing region so that the magnetic brush brushes a surface of the latent image carrying member in the developing region and that the latent image on the latent image carrying member is visualized. In the thus-configured novel image developing apparatus, a developing nip is formed in such a small size that a time period in which a toner of the magnetic brush moves to the developer carrying member back from the latent image carrying member is reduced when the magnetic brush brushes a non-image portion of the surface of the latent image carrying member in the developing region and a density of the magnetic brush is increased so that an electric field for image development is evenly formed.

A developing gap between the developer carrying member and the latent image carrying member may be made relatively small.

The magnetic brush may move from an upstream to a downstream of the developing region at a relatively fast speed.

The developer carrying member may includes a developing sleeve and a magnet roller which is provided inside the developing sleeve and which includes a plurality of magnets, one of which has an arrangement of a smallest half-value angle and is determined as a magnet having a developing magnetic pole.

The half-value angle of the developing magnetic pole may be about 80% of the half-value angle of adjacent magnets.

A center angle in the magnet roller between boundaries of the developing magnetic pole and a magnetic pole of one adjacent magnet and of the developing magnetic pole and a magnetic pole of another adjacent magnet may be about 60 degrees or less.

At least the developing magnetic pole amongst other magnetic poles may be formed by a rare-earth metal alloy magnet.

A magnetic force of the developing magnetic pole may be about 60 mT or more.

A developing nip formed on the developer carrying member may be greater than a diameter of a developer particle and is about 2 mm or less.

A chain segment of the magnetic brush made of the developer and formed on the developing sleeve of the developer carrying member may have a width of about 2 mm or less at a base portion thereof.

The present invention further provides an image developing apparatus which includes a latent image carrying member and a developer carrying member. The latent image carrying member is configured to carry a latent image. The developer carrying member includes a developing sleeve and a magnet roller which is provided inside the developing sleeve and has a plurality of magnets one of which has a developing magnetic pole. The developer carrying member is configured to carry a developer, to cause the developer to rise in a form of chain segments so as to form a magnetic brush on a surface of the developer carrying member with a magnetic force of the developing magnetic pole, and to cause the magnetic brush to brush a surface of the latent image carrying member so that the latent image on the latent image carrying member is visualized. In this configuration, the developing magnetic pole has in its normal direction a predetermined magnetic flux density of which attenuation rate is about 40% or more.

Further, the present invention provides a novel magnet roller for serving as an image carrying member for use in an image developing apparatus. In one embodiment, a novel magnet roller includes a developing sleeve and a magnet roller. The developing sleeve is configured to carry developer. The magnet roller is provided inside the developing sleeve and has a plurality of magnets one of which has a developing magnetic pole for causing the developer to rise in a form of chain segments so as to perform an image visualization relative to a latent image. In this configuration, the developing magnetic pole has in its normal direction a predetermined magnetic flux density of which attenuation rate is about 40% or more.

Further, the present invention provides a novel image forming apparatus which includes anyone of the image developing apparatuses described above.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 8. is a table showing results of the experimental measurements on exemplary embodiments 1–3 and the conventional examples 1–3.

DESCRIPTION OF THE PREFERRED EMBODIMENTS

Figure 1:
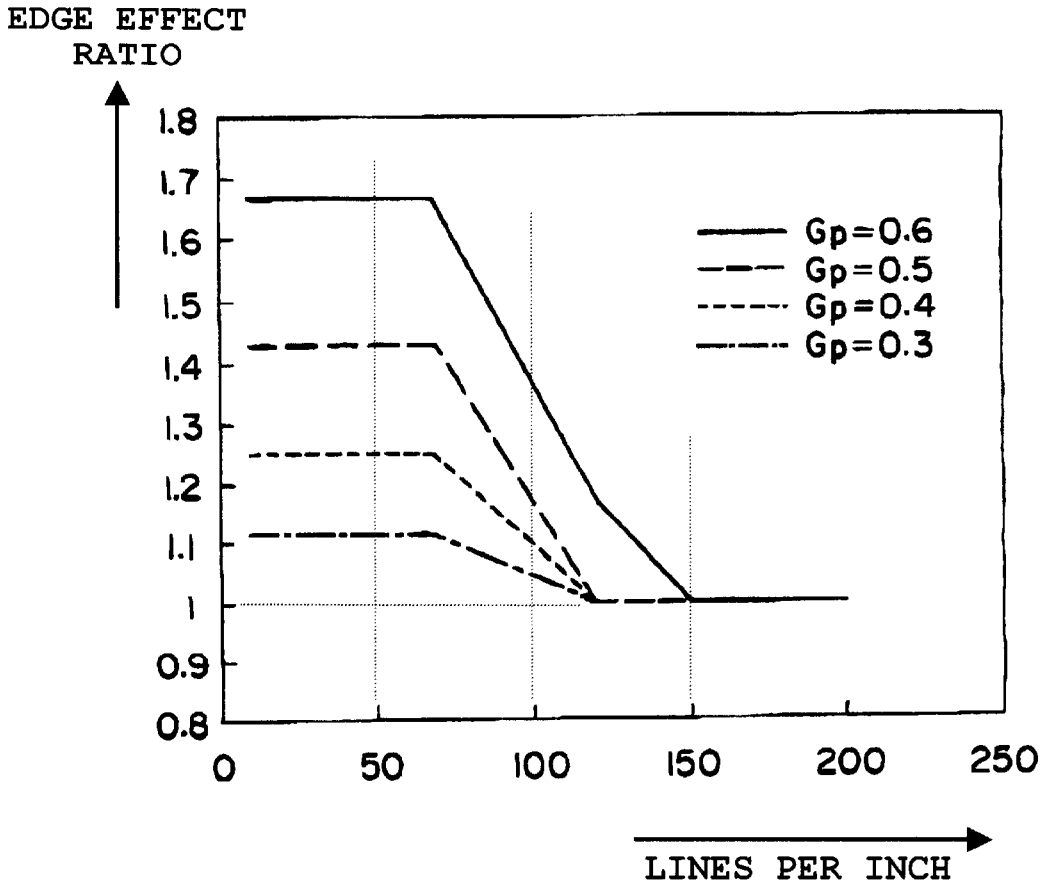
Fig. 1 (PRIOR ART)
FIG. 1 is a graph of background arts showing degrees of edge effect according to variations of image density and a developing gap.
Figure 2A:
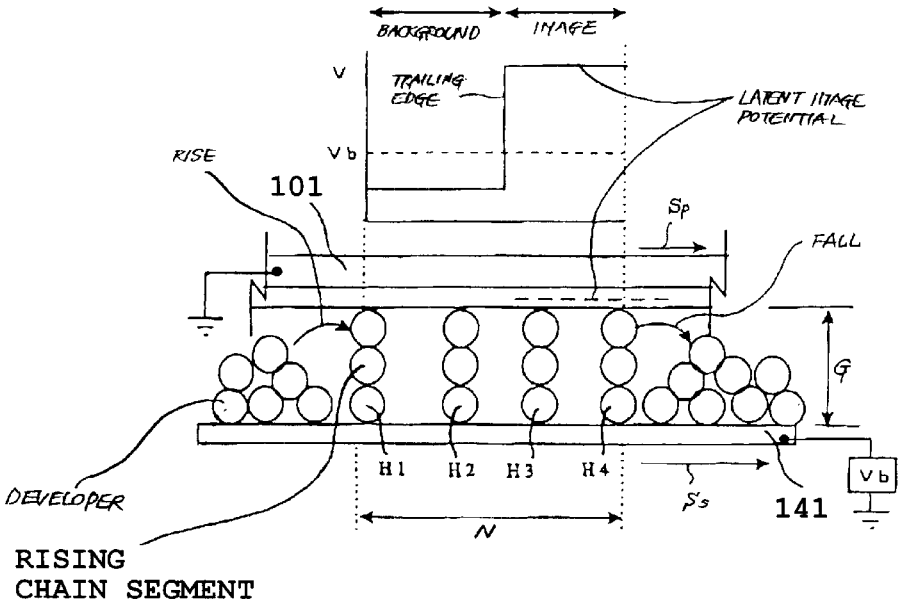
Fig. 2A (PRIOR ART)
FIGS. 2A and 2B are illustrations of background arts for explaining mechanisms of a latent image carrying member and a developer carrying member in a developing region.
Figure 2B:
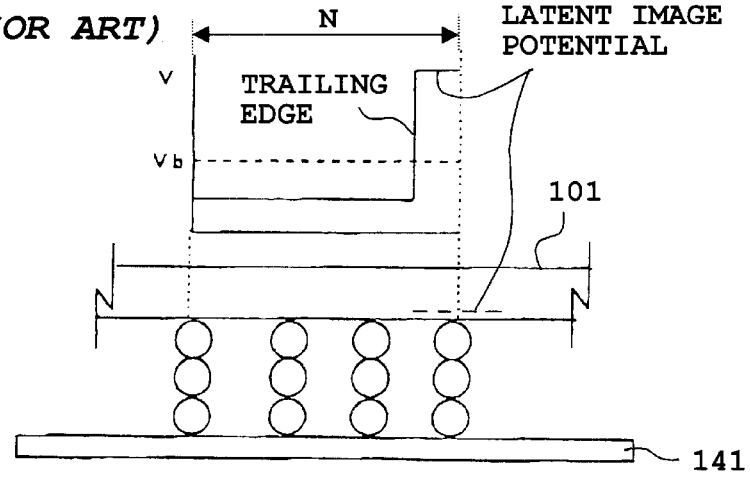
Fig. 2B (PRIOR ART)
Figure 3A:
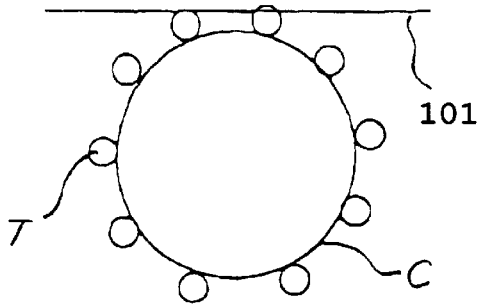
Fig. 3A (PRIOR ART)
FIGS. 3A–3D are illustrations of background arts for explaining behaviors of toner when passing through a developing nip.
Figure 3B:
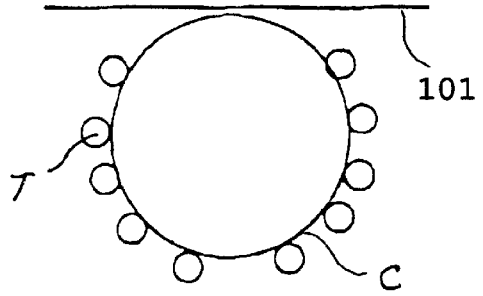
Fig. 3B (PRIOR ART)
Figure 3C:
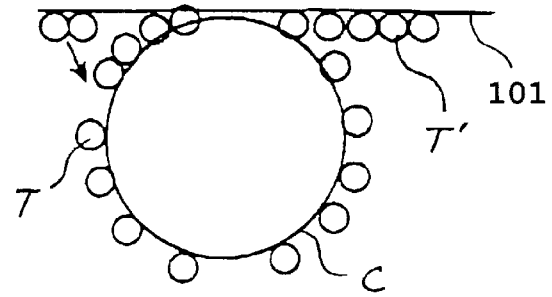
Fig. 3C (PRIOR ART)
Figure 3D:
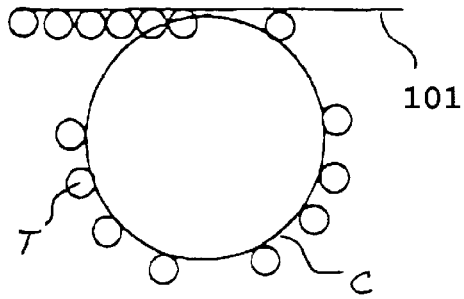
Fig. 3D (PRIOR ART)

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Figure 4:
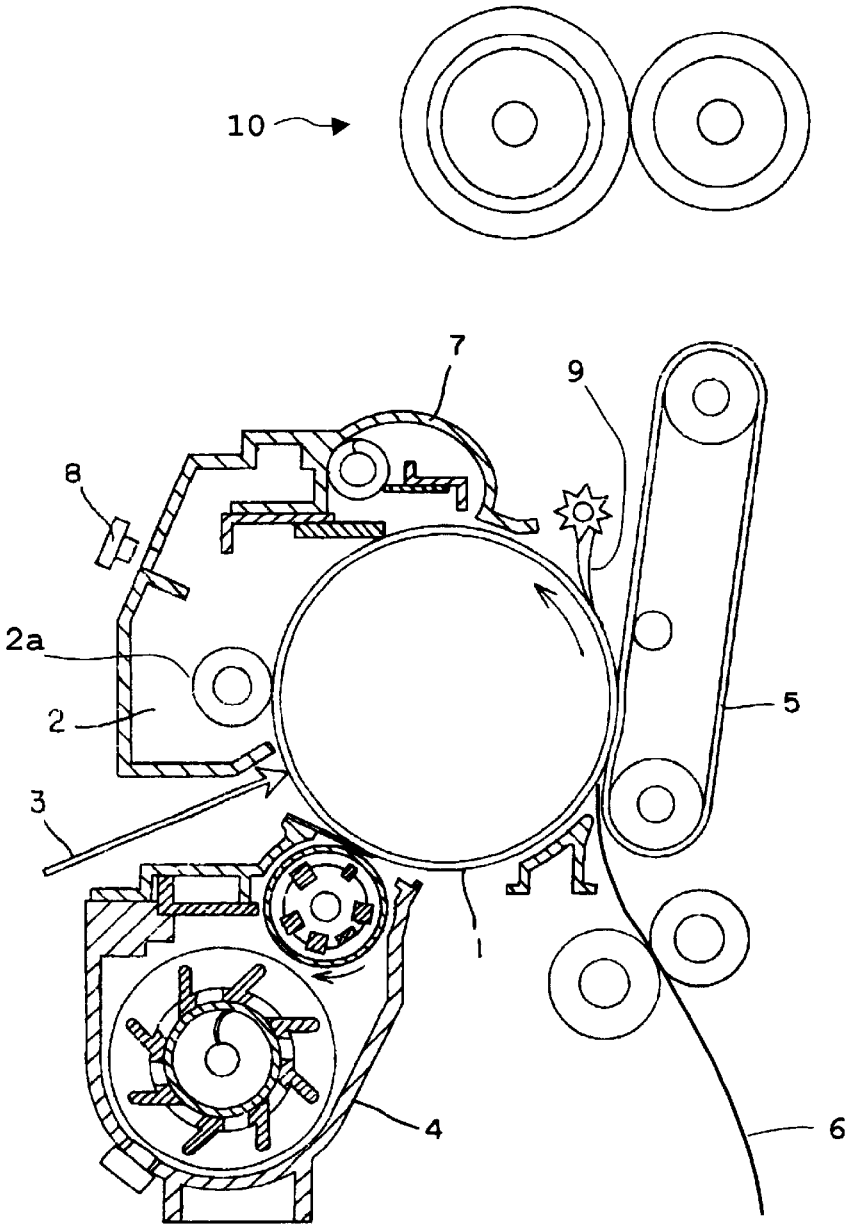
FIG. 4 is a schematic view showing an image forming apparatus according to an embodiment of the present invention.

Referring now to the drawings, wherein like reference numerals designate identical or corresponding parts throughout the several views, and more particularly to FIG. 1 thereof, an image forming apparatus according to an exemplary embodiment of the present invention is illustrated. As shown in FIG. 4, the image forming apparatus includes an image carrier implemented as a photoconductive drum 1 and various components including a charger 2, laser optics 3, a developing device 4, an image transfer device 5 including a belt 5*a*, a drum cleaning device 7, a discharge lamp 8, and a peeler 9, which are sequentially arranged around the photoconductive drum 1. The image forming apparatus further includes a fixing device 10. The charger 2 includes a charger roller 2*a* and uniformly charges the surface of the photoconductive drum 1 with the charger roller 2*a*. The laser optics 3 scans the charged surface of the photoconductive drum 1 with a laser beam to generate a latent image. The developing device 4 develops the latent image with charged toner to form a corresponding toner image. The image transfer device 5 transfers the toner image from the photoconductive drum 1 to a recording medium (i.e., a paper sheet) 6. The drum cleaning device 7 removes toner left on the photoconductive drum 1 after image transfer, and then the discharge lamp 8 dissipates charge left on the photoconductive drum 1. The peeler 9 peels the recording medium 6 attracted to the surface of the photoconductive drum 1 by the electrostatic force therefrom. The fixing device 10 fixes toner on the recording medium 6.

With the arrangement as mentioned above, the image forming apparatus of FIG. 4 performs an image forming operation. During the image forming operation, the charger roller 2*a* of the charger 2 uniformly charges the surface of the photoconductive drum 1. The laser optics 3 forms a latent image on the charged surface of the photoconductive drum 1. The developing device 5 develops the latent image with toner and produces a corresponding toner image. The image transfer device 5 transfers the toner image from the photoconductive drum 1 to the recording medium 6 fed from a sheet tray (not shown). At this instant, the peeler 9 peels off the recording medium 6 adhering to the photoconductive drum 1 by the electrostatic force. The fixing device 10 fixes the toner on the recording medium 6. Subsequently, the drum cleaning device 7 removes and collects the toner left on the photoconductive drum 1 after the image transfer from the photoconductive drum 1 to the recording medium 6. The discharge lamp 8 then initializes the photoconductive drum 1 so as to prepare it for the next image forming cycle.

Figure 5:
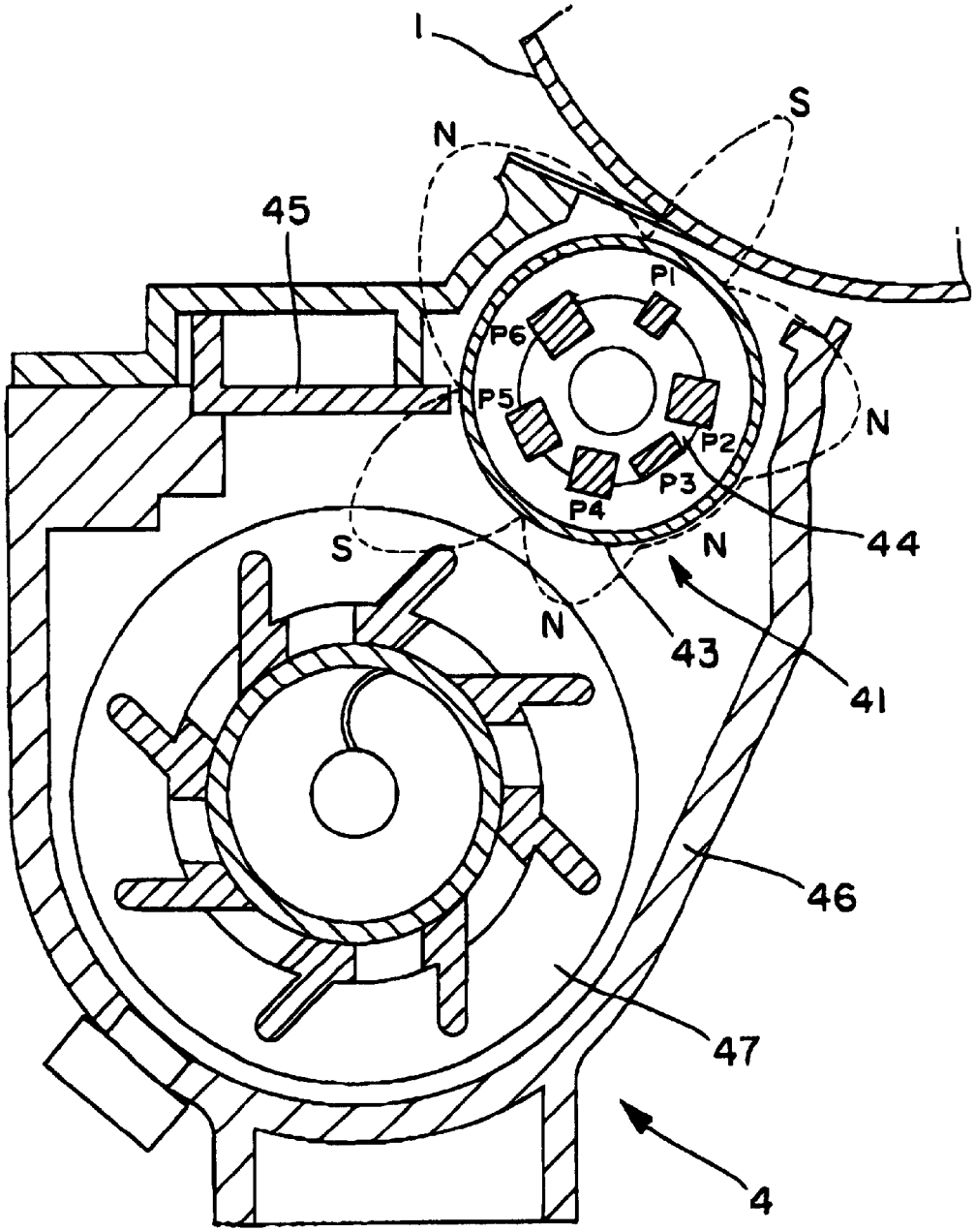
FIG. 5 is a schematic section view showing a specific configuration of an image developing apparatus included in the image forming apparatus of FIG. 4.

Referring to FIG. 5, the structure of the developing device 4 is explained in details. As illustrated in FIG. 5, the developing device 4 includes a developing roller 41, a doctor blade 45, a developing casing 46, and a screw member 47. The developing roller 41 includes a development sleeve 43 and a magnet roller member 44, and is disposed in the developing device 4 to adjoin the photoconductive drum 1 so that a region for image developing is formed between the developing roller 41 and the photoconductive drum 1. The developing sleeve 43 has a cylindrical shape and a hollow and is made of aluminum, brass, stainless steel, conductive resin, or similar nonmagnetic material. The developing sleeve 43 is rotated clockwise by a driving mechanism (not shown). The photoconductive drum 1 has a diameter of 60 mm and moves at a linear velocity of 240 mm/s while the developing sleeve 43 has a diameter of 20 mm and moves at a linear velocity of 600 mm/s. Accordingly, the ratio of the linear velocity of the sleeve 43 to that of the photoconductive drum 1 is 2.5. A space formed between the developing sleeve 43 and the photoconductive drum 1 is referred to as a developing gap. In the example being explained, the developing gap is set to 400 $\mu$m. A needed image density can be obtained even if a ratio of a line velocity of the developing sleeve 43 relative to a line velocity of the photoconductive drum 1 is decreased to such a small value of 1.1.

The magnet roller member 44 is immovably mounted inside the developing sleeve 43 and causes the developer deposited on the rotating developing sleeve 43 to rise in a form of a chain segment. More specifically, carriers contained in the developer pile up due to the magnetic force to form a rising chain segment on the rotating developing sleeve 43 along the line of a magnetic force in the direction of the normal to the circumference of the magnet roller member 44. Charged toner also contained in the developer adheres to the rising chain segment of the carriers. The carriers and the charged toner thus formed in the rising chain segments and adhered on the rotating developing sleeve 43 are collectively referred to as a magnetic brush. This magnetic brush is conveyed by the developing sleeve 43 in the same direction as the developing sleeve 43 rotates (i.e., in the clockwise direction in FIG. 5).

The doctor blade 45 is positioned upstream of the developing region, formed between the developing roller 41 and the photoconductive drum 1, in the direction in which the developing sleeve 43 conveys the developer (i.e., the clockwise direction in FIG. 5). The doctor blade 45 regulates the height of the head of the developer chain, i.e., the amount of developer deposited on the developing sleeve 43. A space formed between the developing sleeve 43 and the doctor blade 45 is referred to as a doctor gap. In this example being explained, the doctor gap is set to 400 $\mu$m. The screw member 47 is positioned at the side opposite to the photoconductive drum 1 with respect to the developing roller 41 in order to scoop up the developer stored in the developing casing 46 while agitating it.

The above-mentioned magnet roller member 44 includes a plurality of magnets such that the same plurality of magnet poles are provided to the circumference of the magnet roller member 44. More specifically, the magnet roller member 44 includes magnets P1–P6, as shown in FIG. 3. Each magnet is oriented in the radial direction of the developing sleeve 43. The magnet P1 is a main magnet and causes the developer deposited on the developing sleeve 43 to rise so as to form the head in the developing region. The magnets P2 and P3 serve to convey the developer over a region following the developing region. The magnet P4 causes the developer to deposit on the developing sleeve 43. The magnets P5 and P6 serve to convey the developer deposited on the developing sleeve 43 to the developing region. As an alternative to the magnet roller member 44 having six magnets, the magnet roller member having eight magnets may be used by arranging additional magnets or magnet poles between the magnet P3 and the doctor blade 45 to enhance the ability to scoop up the developer and the ability to follow a black solid image.

A illustrated in FIG. 5, the above-mentioned main magnet P1 has a relatively small size but generates a relatively great energy indicated by a dashed-line. This main magnet P1 is made of rare-earth metal alloy or samarium alloy, particularly, samarium-cobalt alloy. For example, iron-neodium-boron alloy and iron-neodium-boron alloy bond magnets are of typical amongst rare-earth metal alloy magnets, having maximum energy products of about 358 kJ/m$^3$ and of about 80 kJ/m$^3$, respectively. In contrast, the conventional ferrite or ferrite bond magnets has a maximum energy product of about 36 kJ/m$^3$ or about 20 kJ/m$^3$, respectively. That is, the rare-earth metal alloy magnets can provide the roller surface with a required magnetic force even with a relatively great reduction in size. If there is no space restriction, a ferrite or ferrite bond magnet roller having a relatively great diameter may be used. As an alternative, thinning the tip of the magnet adjoining the developing sleeve may cause a similar effect which actually reduces a half-value angle.

In this case, the above-mentioned half-value angle is an angle formed by two radius lines, relative to the center of the developing roller 41, passing through two points of the magnetic field around the developing magnet P1. At each of these two points, the strength of magnetic field is half of the peak magnetic flux density.

Figure 6:
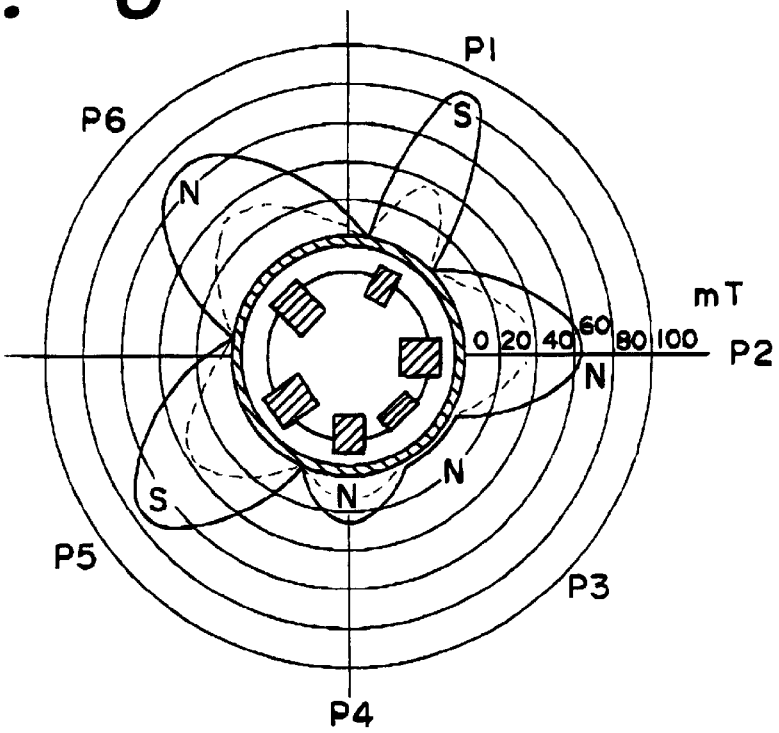
FIG. 6 is a circle chart showing the magnetic force distribution of a development roller included in the image developing apparatus of FIG. 5 and the sizes of magnetic forces.
Figure 7:
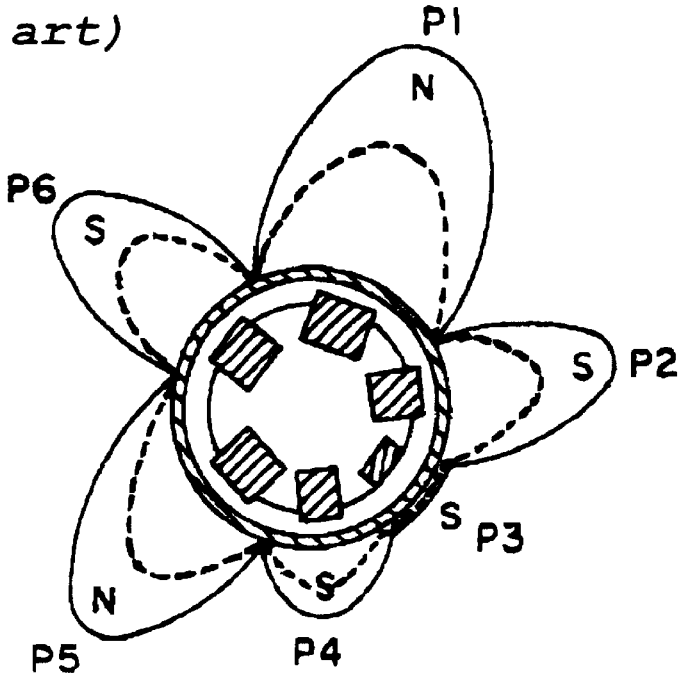
Fig. 7 (prior art)
FIG. 7 is a view similar to FIG. 6, showing the magnetic distribution of a conventional developing roller for comparison.

In the image forming apparatus of FIG. 1, the magnets P4, P6, P2, and P3 are magnetized to the n-pole while the magnets P1 and P5 are magnetized to the s-pole. The circle chart of FIG. 6 shows the flux densities of the magnets P1–P6 in the direction of the normal to the circumference of the magnet roller member 44 determined by measurements. As shown in FIG. 6, the magnet P1 had a magnetic force of 85 mT or more in the direction of the normal to the circumference of the magnet roller member 44. It was experimentally found that a defective image including one with carriers deposited on an image was obviated when the magnet P1 had a magnetic force of 60 mT or more. In this case, the main magnet P1 had a width of 2 mm and a half-value angle of 22 degrees. It was found that a further reduction of the half-value angle was made possible by a further reduction of the width of the main magnet P1. When the main magnet P1 was 1.6 mm wide, the main pole had a half-value angle of 16 degrees. The experiments showed that a defective image was generated when the main magnet was set to a half-value angle of more than 25 degrees. For the purpose of comparison, an arrangement of the magnetic forces by the conventional magnetic roller member is illustrated in FIG. 7.

Referring again to FIG. 6, an attenuation ratio of the flux density in the direction normal to the developing sleeve is explained. In FIG. 6, solid curves are representative of flux densities measured on the surface of the developing sleeve 43 while phantom curves are representative of flux densities measured at a distance of 1 mm from the surface of the developing sleeve 43. For comparison, FIG. 7 shows a flux density distribution available with a conventional magnet roller. For measurement, a gauss meter HGM-8300 and an axial probe type A1 available from ADS were used. The result of measurement were recorded by a circle chart recorder.

In the embodiment being explained, the flux density of the main magnet P1 in the direction normal to the surface of the developing sleeve 43 was measured to be 95 mT on the surface of the developing sleeve 43 or 44.4 mT at the distance of 1 mm from the surface of the developing sleeve 43. That is, the flux density varied by 50.8 mT. In this case, the attenuation ratio of the flux density in the direction normal to the developing sleeve 43 was 53.5%. It is to be noted that the attenuation ratio is produced by subtracting the peak flux density at the position spaced by 1 mm from the surface of the developing sleeve 43 from the peak flux density on the surface of the developing sleeve 43 and then dividing the resulting difference by the latter peak flux density.

In this example, only the brush portion formed by the main magnet P1 contacts the photoconductive drum 1 and develops a latent image formed on the photoconductive drum 1. In this connection, the magnet brush was about 1.5 mm long at the above position when measured without contacting the photoconductive drum 1. Such a magnet brush was shorter than the conventional length of about 3 mm and therefore more dense than the conventional magnet brush.

For a given distance between the doctor blade 45 and the developing sleeve 43, i.e., for a given amount of developer to pass the doctor blade 45, the present embodiment made the magnet brush shorter and more dense than the conventional magnet brush at the developing region, as determined by experiments. This will also be understood with reference to FIG. 6. Because the flux density in the normal direction measured at the distance of 1 mm from the surface of the developing sleeve 43 noticeably decreases, the magnet brush cannot form a chain at a position remote from the surface of the developing sleeve 43 and is therefore short and dense. In this connection, as shown in FIG. 7, the flux density available with the main pole of the conventional magnet roller was 73 mT on the surface of the developing sleeve 43 or 51.8 mT at the distance of 1 mm from the surface of the developing sleeve 43; the flux density varied by 21.2 mT and the attenuation ratio was 29%.

FIG. 8 shows a table in which the measurements of the peak magnetic flux density (F.D), the half-value angle (H.V.A), and the attenuation ratio (A.R) relative to each magnet made on embodiments 1–3 according to the present invention are listed, as well as those made on the conventional magnet rollers as prior art examples 1–3 for the purpose of comparison. Marks of "-" in the table indicate the cases in which the items were not measurable. It is possible to reverse the polarity of the magnets. For example, in the case of the embodiment 1, the magnet P1 may be magnetized to the s-pole instead of the n-pole and accordingly the magnets P2, P3, P4, P5, P6, P7, and P8 be magnetized to the n-, n-, n-, s-, n-, s-, and n-poles, respectively. The embodiments 2 and 3, also the prior art examples 1–3 were cases in which the magnetic roller member were provided with six magnets. In each of the embodiments 1–3, the developing magnet P1 had a magnetic force smaller than those of other magnets so as to be able to obviate a defective image. In the prior art examples 1–3, production of the defective images including the rear-edge omission defect and the defect of the horizontal and vertical line width ratio were observed.

Figure 9:
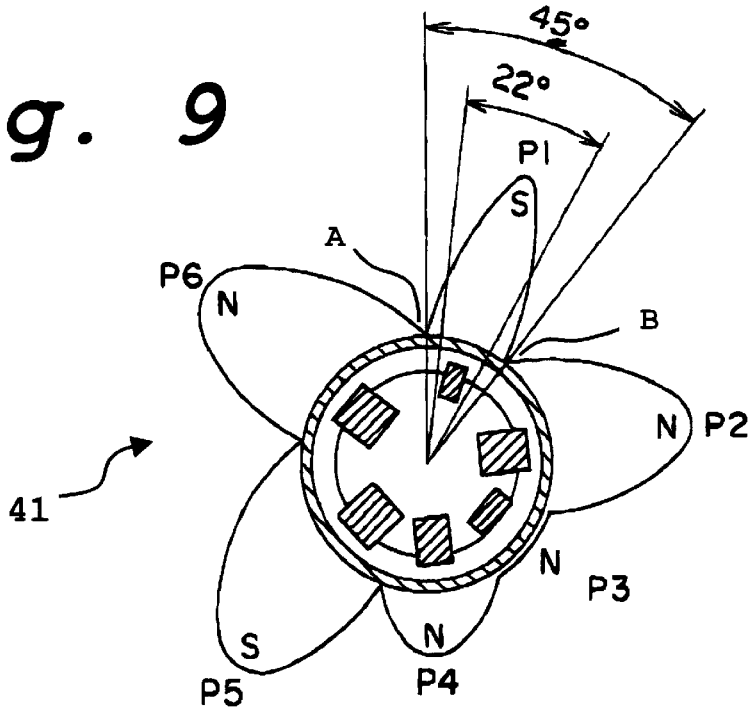
FIG. 9 is an illustration for explaining an arrangement of angle relating to the developing magnet of the image developing apparatus of FIG. 5.

FIG. 9 shows the arrangement of angles relative to the developing magnet P1 inside the developing roller 41. As described earlier, the half-value angle relative to the magnetic field around the developing magnet P1 is preferably set to 22 degrees or less. More preferably, the half-value angle is set to 18 degrees or less. In addition to this, there is another angle to be noted. This angle is referred to as a center angle, and is formed by two radius lines, relative to the center of the developing roller 41, passing through two pole alternation points, indicated by letters A and B in FIG. 9, of magnetic fields around the developing magnet P1. A pole alternation point is defined as a point at which the polarity of a magnetic field is changed from n-pole to s-pole or vice versa, where the strength of magnetic field is 0 mT. The developing magnet P1 produces two pole alternation points; one with the magnet P2 and the other with the magnet P6. In the present embodiment, the angle is set to 45 degrees or less, for example, as shown in FIG. 9.

With the above arrangement, the magnetic force from the developing magnet P1 causes the magnet brush to have a base width of 2 mm or less on the surface of the developing sleeve 43 and accordingly makes the developing nip 2 mm width or less. Thus, it becomes possible to set the developing nip N greater than the diameter of the developer carriers and smaller than 2 mm. This arrangement assures a quality image development without causing the various problems such as the rear-edge omission problem, the horizontal line width problem, and the one-dot image reproduction problem, in such a developing operation in which the magnet brush brushes the photoconductive member in the developing region.

When a toner image formed in a relatively low density (i.e., having a relatively small amount of toner) on the photoconductive member is developed with the magnet brush formed by the magnet roller of the present embodiment, an amount of the counter charge generated on the tip portion of the magnet brush is reduced. This is because magnet brush of the present embodiment makes the developing nip small which accordingly shortens the time period for the magnet brush to brush the surface of the photoconductive member. Thereby, the rear-edge omission problem caused by the developer carrier with the counter charge attracting the toner is reduced. As a result, reproduction of a toner image formed in a relatively low density (i.e., having a relatively small amount of toner) is improved. At the same time, since the height of the magnet brush is shortened, more amount of toner can be supplied to the photoconductive member and the image density is increased. Further, since the developing nip is small, the amount of developer built-up before the nip is reduced and the amount of counter charge charged thereon is reduced. This may also prevent the reduction of the image density.

Figure 10:
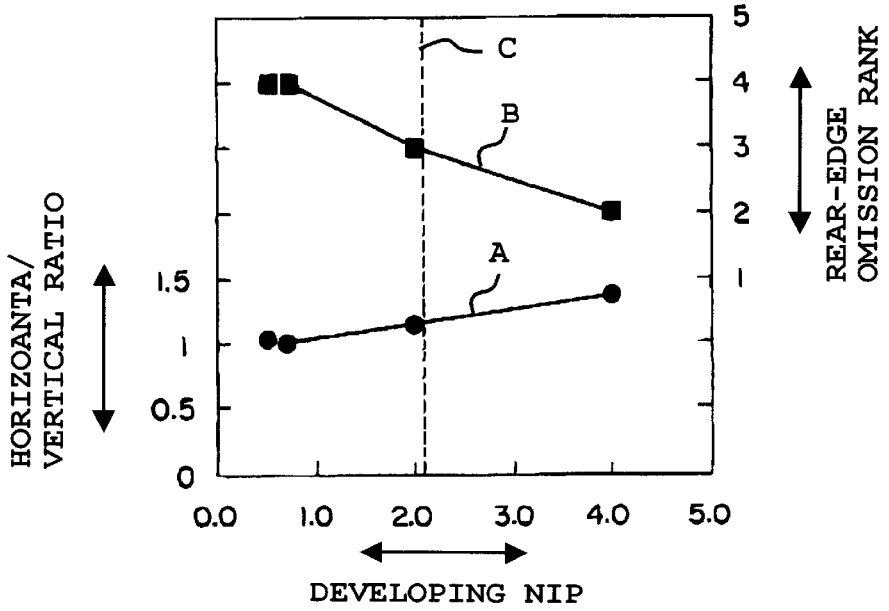
FIG. 10 is a graph for explaining experimental results relating to the horizontal line width problem and the rear-edge omission problem with the variations of the developing nip in the image developing apparatus of FIG. 5.

FIG. 10 is a combined graph showing relationships of the development nip and the horizontal line and rear-edge omission problems. A plot line A represents the relationship of the development nip and the horizontal line problem and a plot line B represents the relationship of the developing nip and the rear-edge omission problem. The horizontal axis represents variations of the developing nip in a range of 0.0 mm to 5.0 mm. The left vertical axis represents the ratio of the horizontal line width to the vertical line width after the development in a range of 0 to 1.5. For example, the ratio is determined as 1 when the width of the horizontal line is equal to that of the vertical line and is determined as 1.5 when it is one-and-a-half times thicker than the vertical line width. The right vertical axis represents the rank of the rear-edge omission problem in a range of 1 to 5. Higher the rank, better the image. The rank and measurements of the rear-edge omission problem levels are according to the corporate standards defined by Ricoh Company, Ltd. In addition, in FIG. 10, the performance of the conventional magnet roller is shown in the right half from a vertical line C which is drawn on the developing nip of about 2.0 and the performance of the present embodiment is shown in the left half.

As shown in FIG. 10, the developing nip below 2 mm achieves the improvements of both the rear-edge omission problem and the horizontal line width problem.

Figure 11:
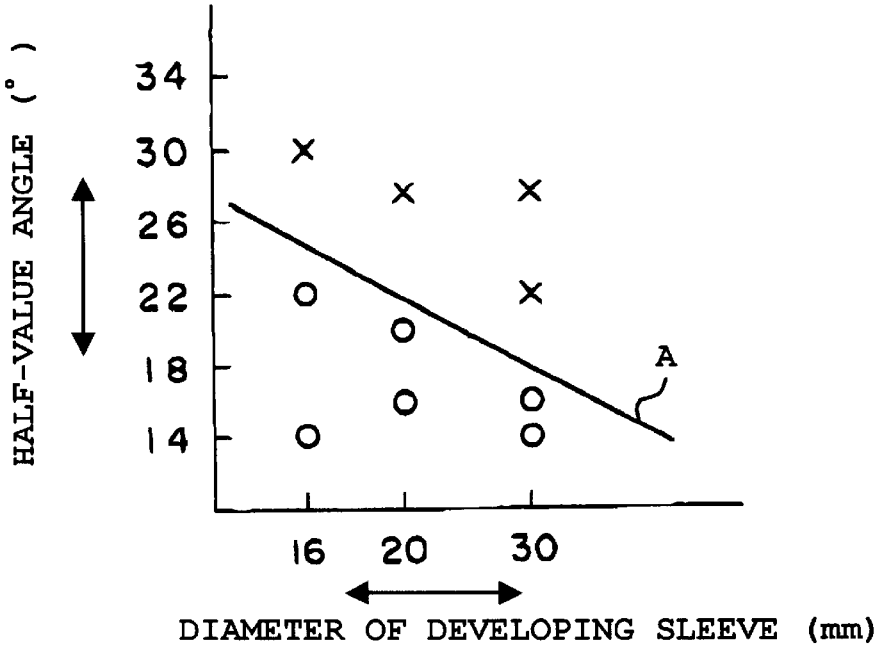
FIG. 11 is a graph for explaining experimental results relating to the rear-edge omission problem with the variations of the diameter of the developing sleeve and the half-value angle in the image developing apparatus of FIG. 5.

FIG. 11 shows experimental results with respect to occurrences of the rear-edge omission problem when the diameter of the developing sleeve 43 and the half-value angle of the developing magnet P1 were varied. In FIG. 11, the horizontal axis represents the diameter of the developing sleeve 43 and the vertical axis represents the half-value angle. According to the above-mentioned rank of the rear-edge omission problem, the measurement results were judged and separated into two groups; one group in which the rear-edge omission problem did not occur and the other group in which the rear-edge omission problem occurred. The results in the former group are indicated with circle marks and the results in the latter group are indicated with cross marks, in FIG. 11. A slant line A in FIG. 11 indicates a border of these two groups.

It is understood from FIG. 11 that the smaller diameter of the developing sleeve 43 and the smaller half-value angle are the factors to prevent the occurrence of the rear-edge omission problem. For example, the rear-edge omission problem was observed when the diameter of the developing sleeve 43 was 16 mm and the half-value angle was 22 degrees but the problem was not observed when the diameter was 30 mm with the same half-value angle. This is because the head of the magnet brush when it rises is still distant from the photoconductive member since the curvature of the circle is great, which causes the magnet brush to contact the photoconductive member in a shorter and efficient time period, thereby producing a less toner return phenomenon. On the other hand, on the developing sleeve 43 having a greater diameter of 30 mm, for example, the position where the magnet brush rises is prone to vary and will therefore produce a greater toner return phenomenon. Therefore, in this case, a smaller half-value angle is needed.

Figure 12:
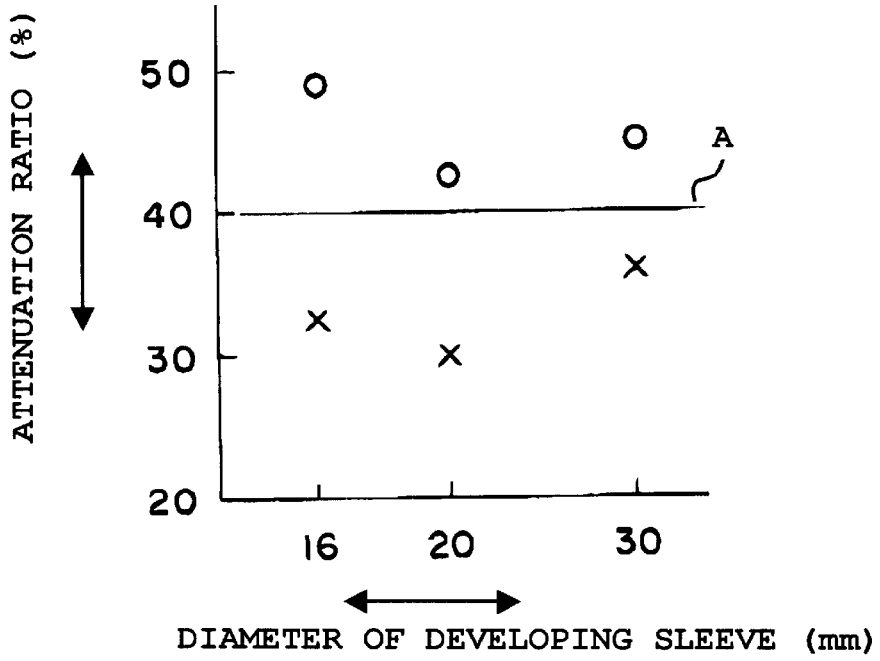
FIG. 12 is a graph for explaining experimental results relating to the rear-edge omission problem with the variations of the diameter of the developing sleeve and the attenuation ratio of the developing magnet in the image developing apparatus of FIG. 5.

FIG. 12 shows experimental results with respect to occurrences of the rear-edge omission problem when the diameter of the developing sleeve 43 and the attenuation ratio of the developing magnet P1 were varied. As described above, the attenuation ratio with respect to the developing magnet P1 is produced by subtracting the peak flux density at the position spaced by 1 mm from the surface of the developing sleeve 43 from the peak flux density on the surface of the developing sleeve 43 and then dividing the resulting difference by the latter peak flux density. In FIG. 12, the horizontal axis represents the diameter of the developing sleeve 43 and the vertical axis represents the attenuation ratio. According to the above-mentioned rank of the rear-edge omission problem, the measurement results were judged and separated into two groups; one group in which the rear-edge omission problem did not occur and the other group in which the rear-edge omission problem occurred. The results in the former group are indicated with circle marks and the results in the latter group are indicated with cross marks, in FIG. 12. A line A in FIG. 12 indicates a border of these two groups and is on the 40%-line of the attenuation ration.

It is understood from FIG. 12 that whether or not the attenuation ratio is above the 40%-line is the factor to obviate the occurrence of the rear-edge omission problem, regardless of the diameter of the developing sleeve 43. The attenuation ratio effects the rise of the magnet brush in the developing nip region. The magnet brush is formed in short and dense with the greater attenuation ratio but is formed longer and rougher with the smaller attenuation ratio. The border is the 40%-line. When the long magnet brush contacts the photoconductive member, the top of the brush is likely bent backwards and therefore the brush density becomes rougher in the developing nip region. On the other hand, an appropriately short and dense magnet brush do not bend and proceeds straight forward with the condition in dense. As a result, the appropriately short and dense magnet brush can evenly apply the developing bias to the latent image and generates a desirable image density with obviating the problems such as the rear-edge omission problem and the horizontal line width problem.

The magnet brush can be formed with a better uniformity when the developing magnet is applied with a higher attenuation ratio. The attenuation ratio was found during the experiments to be increased by an application of a smaller half-value angle. To make the half-value angle smaller, the size of the developing magnet in the circumference direction of the developing sleeve 43 is needed to be made smaller. However, in this case, an amount of the magnet force lines which escape to the adjacent magnets increases and, as a result, the normal magnet flux density at the place distant from the sleeve surface is reduced. More specifically, a substantial clearance that is the sum of the space accommodating the magnet roller member 44 and necessary for the developing sleeve 43 to rotate and the wall thickness of the developing sleeve 43 exists between the magnet roller member 44 and the developing sleeve 43. As a result, the tangential flux density concentrates on the sleeve side, causing the normal flux density to decrease with an increase in the distance from the sleeve surface.

As described earlier, a magnet roller with a great attenuation ratio successfully forms a short and dense magnet brush and, by contrast, the conventional magnet roller with a small attenuation ration forms a long and rough magnet brush. Specifically, a magnetic field formed by the magnet with a great attenuation ration (i.e., the developing magnet P1) is easily attracted by adjoining magnets (i.e., the magnets P2 and P6), so that the flux turns round in the tangential direction rather than spreading in the normal direction. This makes it difficult to form a magnet brush in the normal direction and thereby implements a short and dense magnet brush. As for the magnet P1, for example, having a great attenuation ratio, the rising chain segments adjoining each other in the short magnet brush are more stable than a single elongate chain segment. As for the conventional magnet roller with a small attenuation ratio, the magnet brush does not become short even if the amount of developer to be scooped up is reduced, and has substantially the same as the previously stated magnet brush.

Numerous additional modifications and variations of the present invention are possible in the light of the above teachings. It is therefore to be understood that within the scope of the appended claims, the present invention may be practiced otherwise than as specifically described herein.

What is claimed as new and is desired to be secured by Letters Patent of the United Stated is:

1. An image developing apparatus, comprising:

a latent image carrying member configured to carry a latent image; and a developer carrying member provided in proximity to said latent image carrying member so as to form a developing region between said latent image carrying member and said developer carrying member and configured to carry developer which forms a magnetic brush on a surface thereof and to move said magnetic brush to said developing region so that said magnetic brush brushes a surface of said latent image carrying member in said developing region and that said latent image on said latent image carrying member is visualized, wherein a developing nip is formed in such a small size that a time period in which a toner of said magnetic brush contacts said latent image carrying member is reduced and a density of said magnetic brush is increased so that an electric field produced by the latent image and the developer for image development is evenly formed, and wherein said developer carrying member comprises a developing sleeve and a magnet roller which is provided inside said developing sleeve and which comprises a plurality of magnets, one of said magnets being configured to provide a a smallest half-value angle that is about 80% of the half-value angle of adjacent magnets, and to provide a developing magnetic pole.

2. The image developing apparatus as defined in claim 1, wherein a developing gap between said developer carrying member and said latent image carrying member is made relatively small.

3. The image developing apparatus as defined in claim 1, wherein said magnetic brush moves from an upstream to a downstream of said developing region at a relatively fast speed.

4. The image developing apparatus as defined in claim 1, wherein a center angle in said magnet roller between boundaries of said developing magnetic pole and a magnetic pole of one adjacent magnet and of said developing magnetic pole and a magnetic pole of another adjacent magnet is about 60 degrees or less.

5. The image developing apparatus as defined in claim 1, wherein at least said developing magnetic pole amongst other magnetic poles is formed by a rare-earth metal alloy magnet.

6. The image developing apparatus as defined in claim 1, wherein a magnetic force of said developing magnetic pole is about 60 mT or more.

7. The image developing apparatus as defined in claim 1, wherein a developing nip formed on said developer carrying member is greater than a diameter of a developer particle and is about 2 mm or less.

8. The image developing apparatus as defined in claim 1, wherein the chain segment of said magnetic brush made of said developer and formed on said developing sleeve of said developer carrying member has a width of about 2 mm or less at a base portion thereof.

9. An image developing apparatus, comprising:

a latent image carrying member configured to carry a latent image; and a developer carrying member comprising a developing sleeve and a magnet roller which is provided inside said developing sleeve and has a plurality of magnets one of which has a developing magnetic pole, said developer carrying member configured to carry a developer, to cause said developer to rise in a form of chain segments so as to form a magnetic brush on a surface of said developer carrying member with a magnetic force of said developing magnetic pole, and to cause said magnetic brush to brush a surface of said latent image carrying member so that said latent image on said latent image carrying member is visualized, wherein said developing magnetic pole has in its normal direction a predetermined magnetic flux density of which attenuation rate is about 40% or more.

10. The image developing apparatus as defined in claim 9, wherein a developing nip formed on said developer carrying member is about 2 mm or less.

11. The image developing apparatus as defined in claim 9, wherein a developing gap between said developer carrying member and said latent image carrying member is about 400 $\mu$m or less.

12. The image developing apparatus as defined in claim 9, wherein one of said plurality of magnets has an arrangement of a smallest half-value angle and is determined as a magnet having said developing magnetic pole.

13. The image developing apparatus as defined in claim 12, wherein said half-value angle of said developing magnetic pole is about 80% of the half-value angle of adjacent magnets.

14. The image developing apparatus as defined in claim 12, wherein a center angle in said magnet roller between boundaries of said developing magnetic pole and a magnetic pole of one adjacent magnet and of said developing magnetic pole and a magnetic pole of another adjacent magnet is about 60 degrees or less.

15. The image developing apparatus as defined in claim 12, wherein at least said developing magnetic pole amongst other magnetic poles is formed by a rare-earth metal alloy magnet.

16. The image developing apparatus as defined in claim 12, wherein a magnetic force of said developing magnetic pole is about 60 mT or more.

17. The image developing apparatus as defined in claim 12, wherein a developing nip formed on said developer carrying member is greater than a diameter of a developer particle and is about 2 mm or less.

18. The image developing apparatus as defined in claim 12, wherein the chain segment of said magnetic brush made of said developer and formed on said developing sleeve of said developer carrying member has a width of about 2 mm or less at a base portion thereof.

19. An image developing apparatus, comprising:

a latent image carrying member configured to carry a latent image; and a developer carrying member comprising a developing sleeve and a magnet roller which is provided inside said developing sleeve and has a plurality of magnets one of which has a developing magnetic pole, said developer carrying member configured to carry a developer, to cause said developer to rise in a form of chain segments so as to form a magnetic brush on a surface of said developer carrying member with a magnetic force of said developing magnetic pole, and to cause said magnetic brush to brush a surface of said latent image carrying member so that said latent image on said latent image carrying member is visualized, wherein a half-value angle of said developing magnetic pole is about 22 degrees or less.

20. The image developing apparatus as defined in claim 19, wherein a developing nip formed on said developer carrying member is about 2 mm or less.

21. The image developing apparatus as defined in claim 19, wherein a developing gap between said developer carrying member and said latent image carrying member is about 400 $\mu$m or less.

22. The image developing apparatus as defined in claim 19, wherein one of said plurality of magnets has an arrangement of a smallest half-value angle and is determined as a magnet having said developing magnetic pole.

23. The image developing apparatus as defined in claim 22, wherein said half-value angle of said developing magnetic pole is about 80% of the half-value angle of adjacent magnets.

24. The image developing apparatus as defined in claim 22, wherein a center angle in said magnet roller between boundaries of said developing magnetic pole and a magnetic pole of one adjacent magnet and of said developing magnetic pole and a magnetic pole of another adjacent magnet is about 60 degrees or less.

25. The image developing apparatus as defined in claim 22, wherein at least said developing magnetic pole amongst other magnetic poles is formed by a rare-earth metal alloy magnet.

26. The image developing apparatus as defined in claim 22, wherein a magnetic force of said developing magnetic pole is about 60 mT or more.

27. The image developing apparatus as defined in claim 22, wherein a developing nip formed on said developer carrying member is greater than a diameter of a developer particle and is about 2 mm or less.

28. The image developing apparatus as defined in claim 22, wherein said chain segment of said magnetic brush made of said developer and formed on said developing sleeve of said developer carrying member has a width of about 2 mm or less at a base portion thereof.

29. A developing roller for serving as an image carrying member for use in an image developing apparatus, comprising:

a developing sleeve configured to carry developer; and a magnet roller provided inside said developing sleeve, said magnet roller having a plurality of magnets one of which has a developing magnetic pole for causing said developer to rise in a form of chain segments so as to perform an image visualization relative to a latent image, wherein said developing magnetic pole has in its normal direction a predetermined magnetic flux density of which attenuation rate is about 40% or more.

30. The magnet roller as defined in claim 29, wherein one of said plurality of magnets has an arrangement of a smallest half-value angle and is determined as a magnet having said developing magnetic pole.

31. The magnet roller as defined in claim 30, wherein said half-value angle of said developing magnetic pole is about 80% of the half-value angle of adjacent magnets.

32. The magnet roller as defined in claim 30, wherein a center angle in said magnet roller between boundaries of said developing magnetic pole and a magnetic pole of one adjacent magnet and of said developing magnetic pole and a magnetic pole of another adjacent magnet is about 60 degrees or less.

33. The magnet roller as defined in claim 30, wherein at least said developing magnetic pole amongst other magnetic poles is formed by a rare-earth metal alloy magnet.

34. The magnet roller as defined in claim 30, wherein a magnetic force of said developing magnetic pole is about 60 mT or more.

35. The magnet roller as defined in claim 30, wherein a developing nip formed on said developer carrying member is greater than a diameter of a developer particle and is about 2 mm or less.

36. The magnet roller as defined in claim 30, wherein said chain segment of said magnetic brush made of said developer and formed on said developing sleeve of said developer carrying member has a width of about 2 mm or less at a base portion thereof.

37. A developing roller for serving as an image carrying member for use in an image developing apparatus, comprising:

a developing sleeve configured to carry developer; and a magnet roller provided inside said developing sleeve, said magnet roller having a developing magnetic pole for causing said developer to rise in a form of chain segments so as to perform an image visualization relative to a latent image, wherein a half-value angle of said developing magnetic pole is about 22 degrees or less.

38. The magnet roller as defined in claim 37, wherein one of said plurality of magnets has an arrangement of a smallest half-value angle and is determined as a magnet having said developing magnetic pole.

39. The magnet roller as defined in claim 38, wherein said half-value angle of said developing magnetic pole is about 80% of the half-value angle of adjacent magnets.

40. The magnet roller as defined in claim 38, wherein a center angle in said magnet roller between boundaries of said developing magnetic pole and a magnetic pole of one adjacent magnet and of said developing magnetic pole and a magnetic pole of another adjacent magnet is about 60 degrees or less.

41. The magnet roller as defined in claim 38, wherein at least said developing magnetic pole amongst other magnetic poles is formed by a rare-earth metal alloy magnet.

42. The magnet roller as defined in claim 38, wherein a magnetic force of said developing magnetic pole is about 60 mT or more.

43. The magnet roller as defined in claim 38, wherein a developing nip formed on said developer carrying member is greater than a diameter of a developer particle and is about 2 mm or less.

44. The magnet roller as defined in claim 38, wherein said chain segment of said magnetic brush made of said developer and formed on said developing sleeve of said developer carrying member has a width of about 2 mm or less at a base portion thereof.

45. An image forming apparatus using an image developing apparatus as defined in anyone of claims 1–28.

46. A method for image developing, comprising the steps of:

providing a latent image carrying member;

placing a latent image on said patent image carrying member;

providing a developer carrying member in proximity to said latent image carrying member to form a developing region between said latent image carrying member and said developer carrying member;

placing on a surface of said developer carrying member developer which forms a magnetic brush on said surface of said developer carrying member;

moving said developer carrying member to move said magnetic brush to said developing region so that said magnetic brush brushes a surface of said latent image carrying member in said developing region and that said latent image on said latent image carrying member is visualized, wherein said developer carrying member forms a developing nip in such a small size that a time period in which a toner of said magnetic brush connects said latent image carrying member is reduced and a density of said magnetic brush is increased so that an electric field produced by the latent image and the developer for image development is evenly formed, and wherein said developer carrying member comprises a developing sleeve and a magnet roller which is provided inside said developing sleeve and which comprises a plurality of magnets, one of said magnets being configured to provide a smallest half-value angle and a developing magnetic pole formed by a rare-earth metal alloy magnet.

47. The method as defined in claim 46, wherein said providing step for providing said developer carrying member makes a developing gap relatively small between said developer carrying member and said latent image carrying member.

48. The method as defined in claim 46, wherein said moving step of said developing carrying member moves said magnetic brush at a relatively fast speed from an upstream to a downstream of said developing region.

49. The method as defined in claim 46, wherein said half-value angle of said developing magnetic pole is about 80% of the half-value angle of adjacent magnets.

50. The method as defined in claim 46, wherein a center angle in said magnet roller between boundaries of said developing magnetic pole and a magnetic pole of one adjacent magnet and of said developing magnetic pole and a magnetic pole of another adjacent magnet is about 60 degrees or less.

51. The method as defined in claim 46, wherein a magnetic force of said developing magnetic pole is about 60 mT or more.

52. The method as defined in claim 46, wherein a developing nip formed on said developer carrying member is greater than a diameter of a developer particle and is about 2 mm or less.

53. The method as defined in claim 46, wherein the chain segment of said magnetic brush made of said developer and formed on said developing sleeve of said developer carrying member has a width of about 2 mm or less at a base portion thereof.

* * * * *